US010383458B1

(12) United States Patent
Pagano

(10) Patent No.: US 10,383,458 B1
(45) Date of Patent: Aug. 20, 2019

(54) INFANT SUPPORT SEAT CUSHION

(71) Applicant: Paul Pagano, St. Petersburg, OH (US)

(72) Inventor: Paul Pagano, St. Petersburg, OH (US)

(73) Assignee: Pagano Innovations, LLC, Canfield, OH (US)

( * ) Notice: Subject to any disclaimer, the term of this patent is extended or adjusted under 35 U.S.C. 154(b) by 0 days.

(21) Appl. No.: 15/856,684

(22) Filed: Dec. 28, 2017

(51) Int. Cl.
*A47D 13/08* (2006.01)
*A47D 1/00* (2006.01)
*A47D 15/00* (2006.01)

(52) U.S. Cl.
CPC ..... *A47D 13/083* (2013.01); *A47D 1/0085* (2017.05); *A47D 15/006* (2013.01)

(58) Field of Classification Search
CPC ... A47D 1/0085; A47D 13/083; A47D 15/006
USPC ..... D6/336, 333; 297/149, 452.32, 452.26, 297/183.7
See application file for complete search history.

(56) References Cited

U.S. PATENT DOCUMENTS

| | | | | |
|---|---|---|---|---|
| 5,183,311 | A | 2/1993 | Meeker et al. | |
| 5,519,906 | A | 5/1996 | Fanto-Chan | |
| 5,661,861 | A | 9/1997 | Matthews | |
| 5,964,506 | A * | 10/1999 | Coates | A47D 15/006 128/869 |
| D421,343 | S * | 3/2000 | Bennardo | D6/333 |
| D450,516 | S | 11/2001 | Darling et al. | |
| D450,517 | S | 11/2001 | Darling et al. | |
| 6,626,487 | B1 | 9/2003 | Buitendach | |
| 6,685,024 | B1 | 2/2004 | Matthews | |
| 6,810,545 | B1 | 11/2004 | Darling et al. | |
| D687,638 | S * | 8/2013 | Beda | D6/333 |
| 8,727,448 | B1 * | 5/2014 | Pagano | A47D 1/008 297/250.1 |
| 9,603,464 | B2 * | 3/2017 | Sclare | A47D 1/10 |

* cited by examiner

*Primary Examiner* — Cassandra Davis
(74) *Attorney, Agent, or Firm* — Harpman & Harpman

(57) ABSTRACT

An infant support and stabilization cushion seat to provide a safe and secure containment and retainment of an infant in a sitting position. The support cushion seat is formed of a resilient shape retaining foam core with a yielding encapsulating surface cover material defining a contoured child receiving area therewithin. An insertable access retainment tray portion overlies a portion of the child receiving area with deflectable under child placement and retrieval returning to the original orientation, once released.

5 Claims, 6 Drawing Sheets

INFANT SUPPORT SEAT CUSHION

BACKGROUND OF THE INVENTION

1. Technical Field

This device relates to an infant and child support and stabilization containment cushion that securely confines and supports a child in a desired position.

2. Description of Prior Art

Prior art devices of this type have been directed towards cushion configurations oriented to hold or support an infant, caregiver or adults in engaging manner, see for example U.S. Pat. Nos. 5,183,311, 5,519,906, 5,661,861, 6,626,487, 6,685,024, 6,810,545, and Design Pat. D450,517 and D450,516.

In U.S. Pat. No. 5,183,311 discloses a portable highchair/booster seat having parallel spaced arms on which a detachable tray is secured.

In U.S. Pat. No. 5,661,861 a support pillow is illustrated that is positioned about the upper torso of a user so that the arms can rest thereon in a sitting position.

U.S. Pat. No. 6,626,487 illustrates a baby chair having a contoured integrated one-piece seat, backrest and side supports with tray mounting openings therewithin. A front support defines spaced front openings for the legs with an upright frontal support structure therebetween.

U.S. Pat. No. 6,685,024 shows a support pillow and method of use in which a horseshoe shaped pillow is configured defining a circular opening well within.

U.S. Pat. No. 6,810,545 is directed towards an infant support pillow and method of assembly in which a pillow body has two contoured arms extending from a media region in spaced parallel relation in a U-shaped form.

Design Pat. D450,519 is directed to an infant support pillow having a general horseshoe configuration and Design Pat. D540,516 is an ornamental design wherein an infant support pillow is described in U.S. patent above ending in 545.

Applicant's own U.S. Pat. No. 7,356,861 discloses an infant support seat cushion having multiple pairs of oppositely disposed depending sidewalls with an opening formed in the front wall defined by a pair of abutting arm portions hooked together with fasteners.

Applicant's U.S. Pat. No. 8,727,448 claims an infant seat and stabilization cushion with an integrated flexible access retainment tray.

SUMMARY OF THE INVENTION

An infant support and entertainment cushion chair in which a soft resilient contoured body member is defined with an infant receiving opening centrally located therewithin. The support cushion chair rests on the floor having a wide stable base with the infant positioned therewithin in a seating position. The seat access portion is defined by a insertable, retained tray restraint slidably disposed in and between cushion arm supports extending over and defining a leg receiving opening between the arm support surrounding portions with upper surfaces and activity recess openings therewithin. Auxiliary strap retaining and positioning slots and receiving recess define safety strap alignment for an infant, if used.

DETAILED DESCRIPTION OF THE INVENTION

Figure 1:
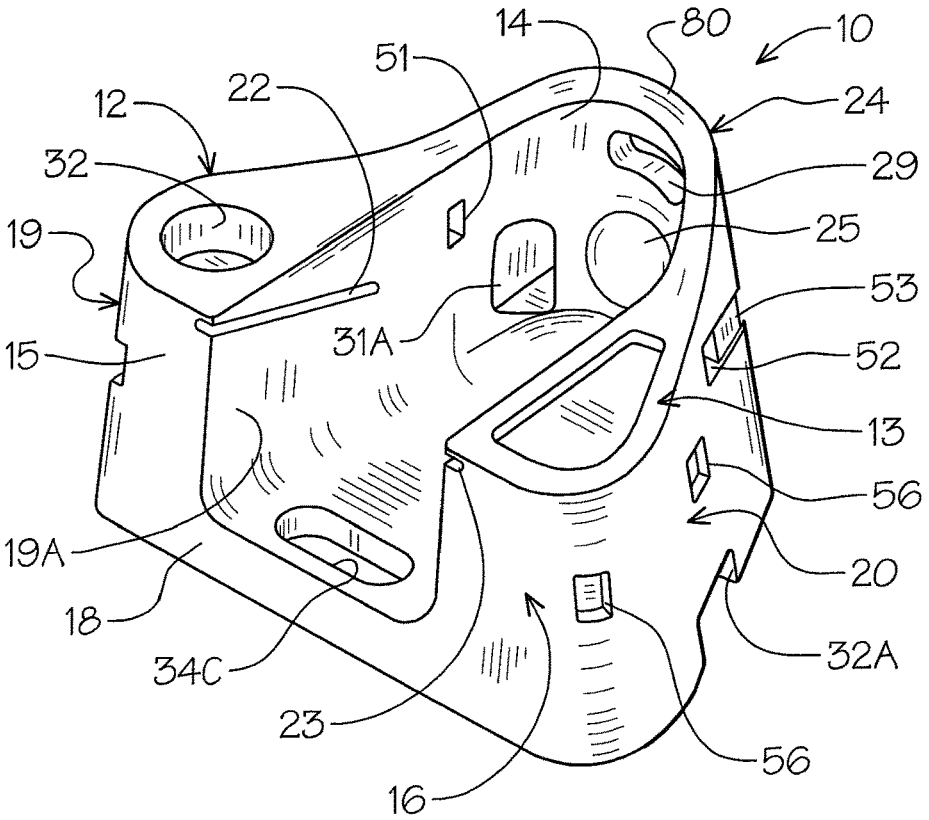
FIG. 1 is a perspective view of the infant support cushion chair.

Referring to FIGS. 1-6 of the drawings, an infant support cushion seat 10 of the invention can be seen having a main monolithic resilient foam core body member 11 of a generally triangular configuration with upper flat arm surfaces 12 and 13, an upstanding contoured back portion 14 and oppositely disposed inclined depending sidewalls 15 and 16. Interconnecting inclined back sidewall 17 and oppositely disposed inclined front sidewall 18. Arm portions 19 and 20 are defined by the arm surfaces 12 and 13 and respectively depending sidewalls 15 and 16. The front depending sidewall 18 has a rectangular access opening 21 within extending to and in communication with a central front wall opening within the main body member 11 between respective arm portions 19 and 20 and respective depending sidewalls 15 and 16.

Figure 5:
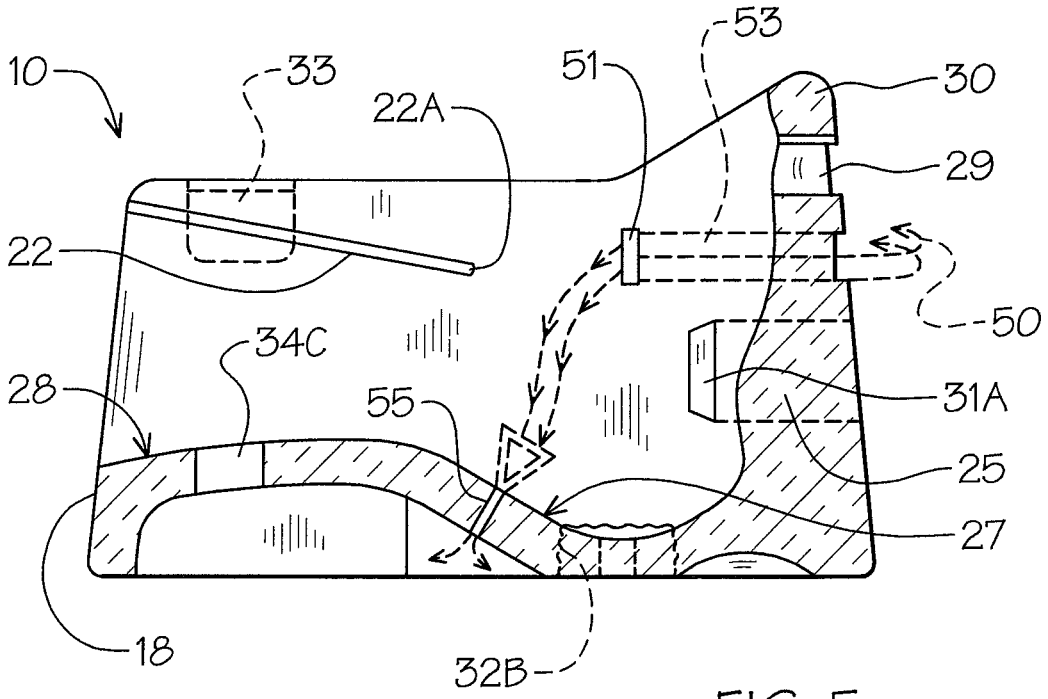
FIG. 5 is a sectional view on lines 5-5 of FIG. 3.

Each of the arm portions 19 and 20 have effacing interior wall surfaces 19A and 20A with respective tray retainment slots 22 and 23 therein, best seen in FIGS. 1 and 5 of the drawings.

The slots 22 and 23 extend in angular relation to the corresponding upper arm surfaces 12 and 13 from the from sidewall 18 in equal space parallel relation to one another to respective termination points indicated at 22A and 23A in spaced relation to the incline back sidewall 17.

Referring now to FIGS. 1, 2, 5 and 6 of the drawings, an elevated back rest portion 24 is defined by the back sidewall 17 so as to provide support to an infant I and has a contoured back support protrusion 25 on its lower inner surface 26 which when combined with a recessed contoured seat bottom 27, best seen in FIG. 5 of the drawings will provide a superior stabilized seating position for the infant I. The front wall opening FWO is in spaced relation to the ground engagement surface of the body member 11 affording therefore an elevated contoured infant leg support surface 28.

Figure 6:
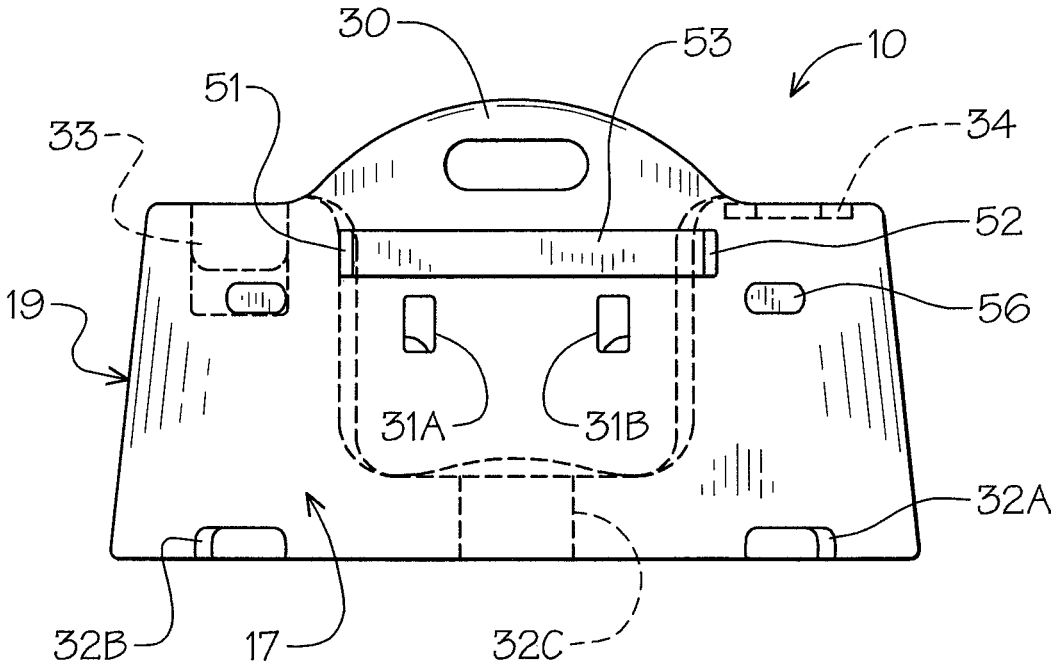
FIG. 6 is a rear elevational view thereof.

A contoured opening at 29 within the back sidewall 17 defines an elongated contoured handgrip 30 formed from the contoured back wall surface, best seen in FIGS. 1, 5 and 6 of the drawings.

A pair of respective angular guide openings 31A and 31B are formed in the contoured back support area adjacent a transition area defined between the arm portions 19 and 20 and contoured back support area to receive an optional infant retaining strap assembly 50 illustrated in broken lines which may be required in a user determined situation.

Typically, the inner seat engagement contours generally indicated at SC, best seen in FIG. 5 of the drawings may be sufficient to support and contain the infant there within without the additional strap restraints, as noted above.

Figure 4:
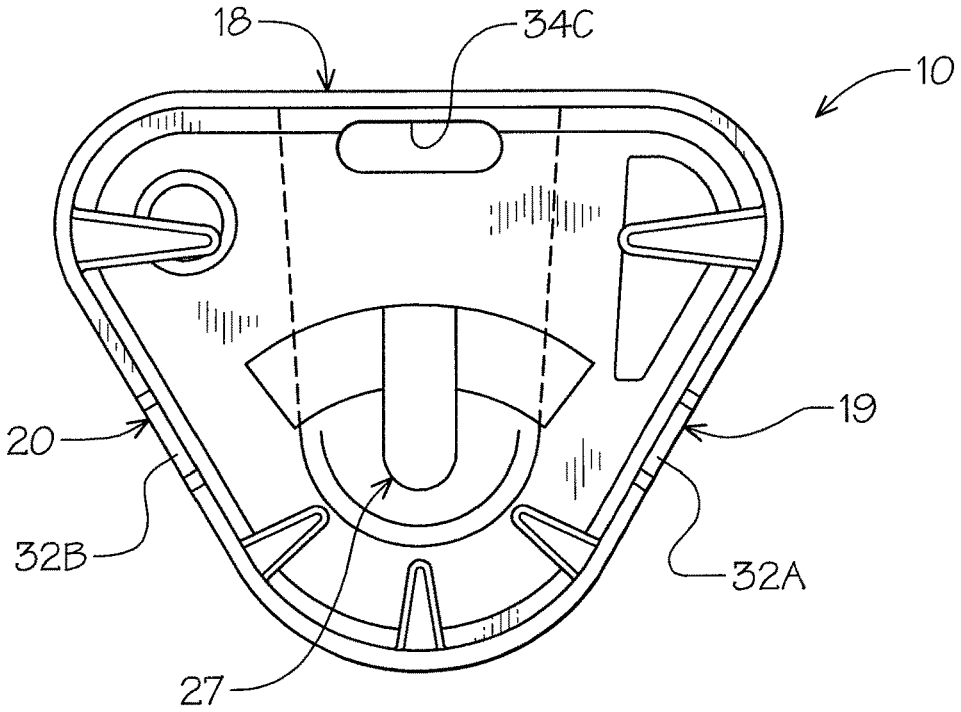
FIG. 4 is a bottom plan view thereof.

A pair of oppositely disposed handgrip engagement openings 32A and 32B are formed within the respective inclined sidewalls extending upwardly from the ground engagement base and a handgrip opening 32C within the front seat bottom 27 defined surfaces to afford a user the ease of movement and transport, as best seen in FIGS. 1, 4 and 5 of the drawings.

Each of the arm portions 19 and 20 have respective receptacles 33 and 34 extending within their upper arm surfaces 12 and 13 to provide for use by the infant placement and positioning of items there within for ease of access and use.

It will be evident from the above description that the infant's arms A will be well above the upper surface 12 and 13 of the arms 21 and 22 and a tray portion 35 allowing for free use thereof as described, as will be described hereinafter.

Figure 2:
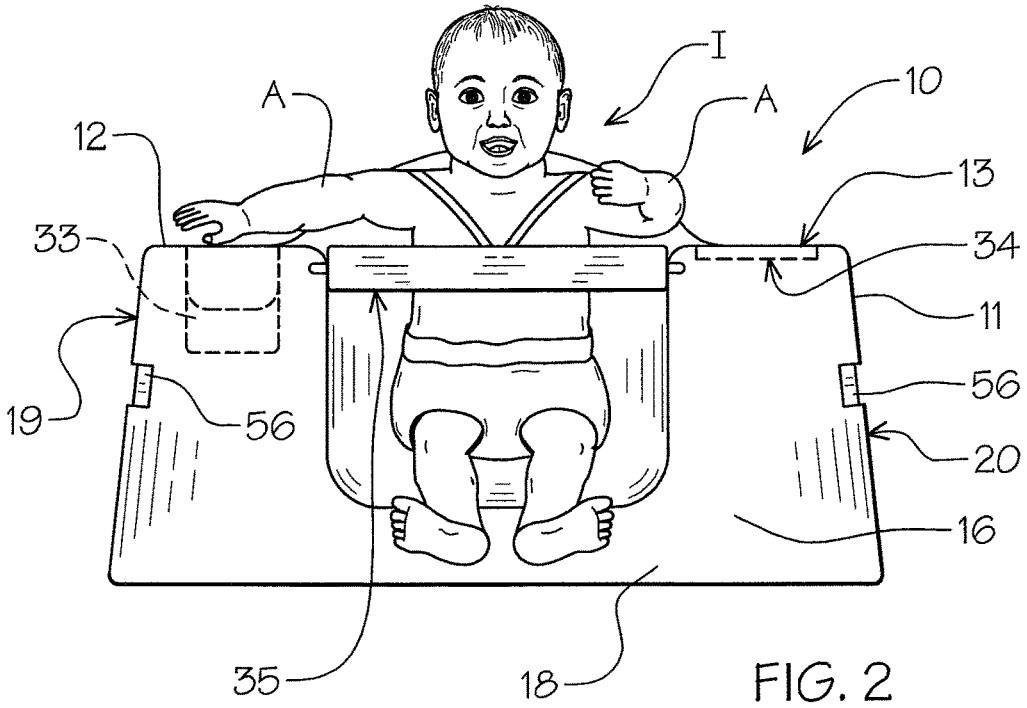
FIG. 2 is a front elevational view thereof showing an infant positioned there within with tray insert.
Figure 3:
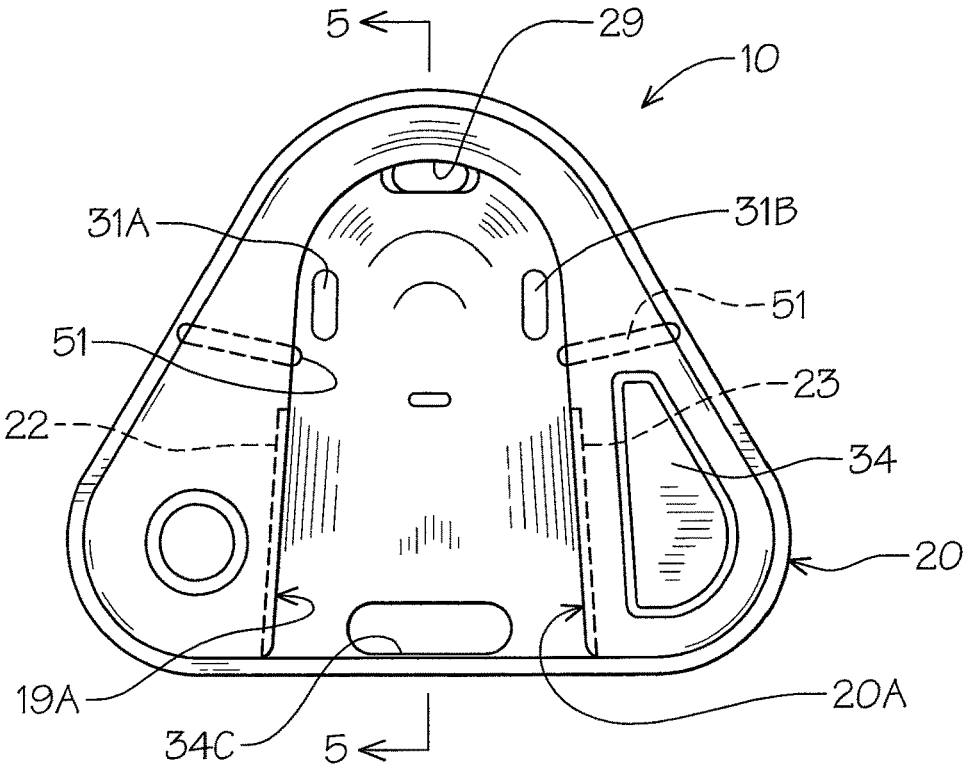
FIG. 3 is a top plan view of the infant cushion support chair, without tray insert.
Figure 7:
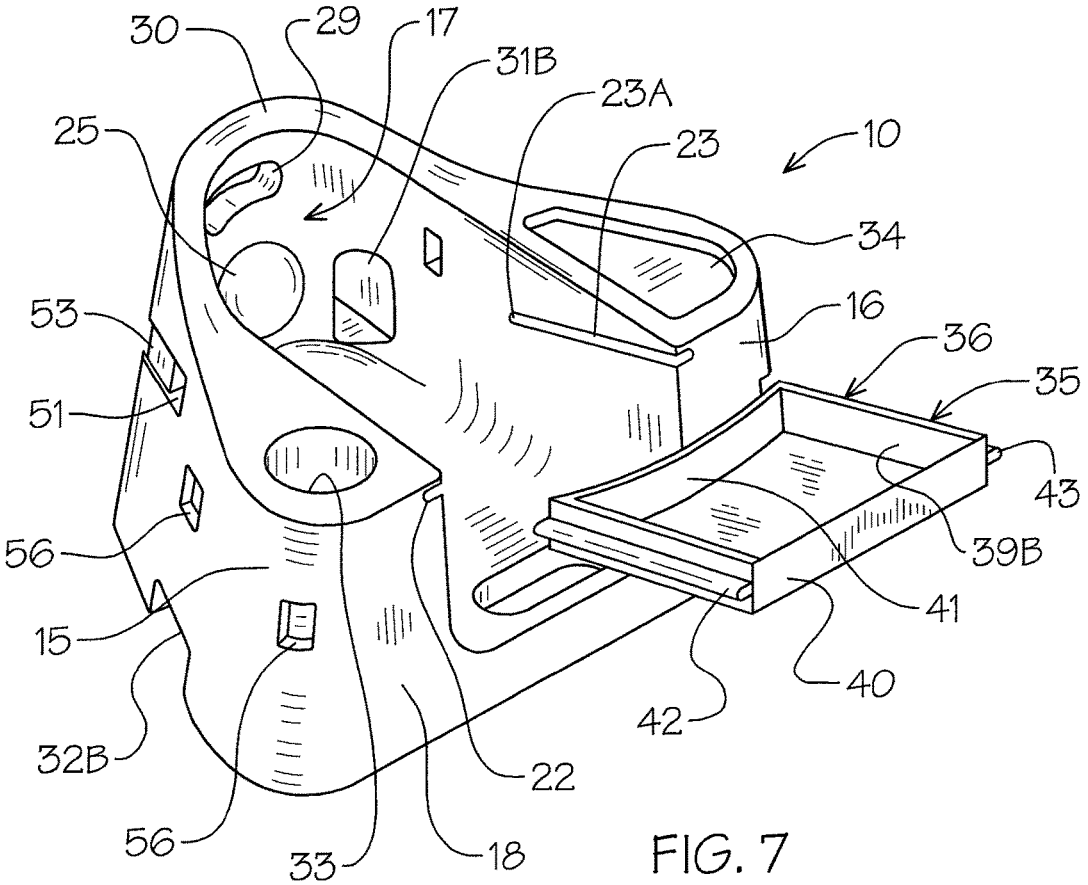
FIG. 7 is a perspective view of the infant support cushion chair with tray insert positioned for insertion.
Figure 8:
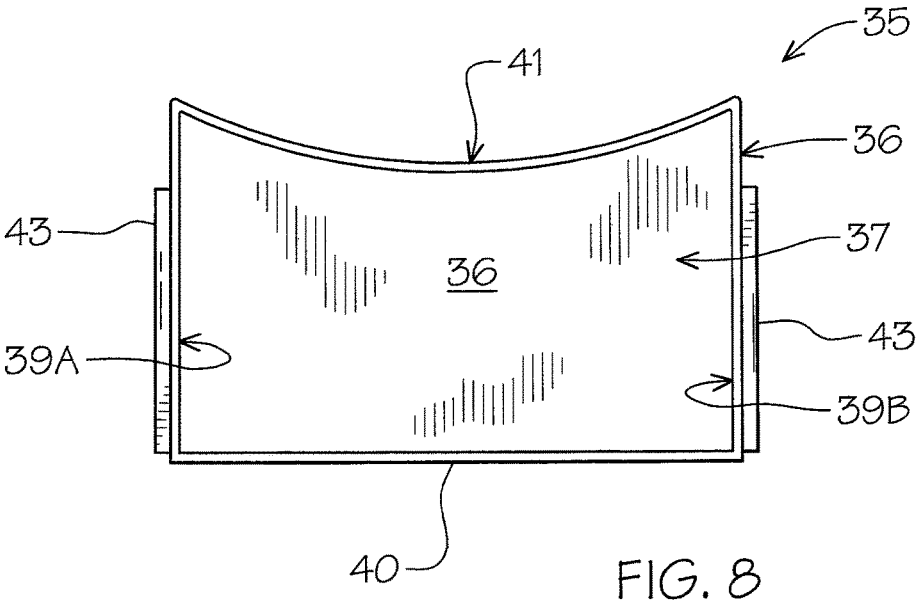
FIG. 8 is a top plan view of the tray insert.

The independent tray portion 35 can be seen in FIGS. 2, 7 and 8 of the drawings having a generally rectangular upstanding interconnected spaced sidewall surfaces 36 with an integral wall engagement bottom surface 37 defining a recess area 38. The sidewall surfaces 36 comprise a pair of spaced parallel sidewalls 39A and 39B and interconnecting front wall 40 with a spaced contoured curvilinear rear wall 41, best seen in FIGS. 7 and 8 of the drawings, to afford clearance of the insertion of the infant I as will be described in detail hereinafter.

A pair of elongated tray support flanges 42 and 43 extend respectively from the sidewall's exterior surface for registration engagement with respective retainment slots 22 and 23 as illustrated in FIGS. 2 and 8 of the drawings.

The tray portion 35 can be slidably disposed within the respective slots 22 and 23 then retained by deformation of the slots imparted by the transformational load of the infant I within the chair SC area indicated by force directional arrows 44. The respective arm portions 19 and 20 will deflect proportionally under center load displacement indicated by arrows 45 in FIG. 9 of the drawings, engaging the tray support flanges 42 and 43 there between as indicated in broken lines securely holding the independent tray portion 35 in place.

It will be seen that the flexibility and material memory of the arm portions 12 and 13 due to the construction design and materials of choice in which the body member is formed of a resilient synthetic resin foam core of a shape retaining density sufficient to provide yielding deflecting support to the infant I when placed within the central opening 22 of the cushion chair seat and transvertical deflection of the arm portions 19 and 20. A synthetic foam core is preferably encapsulated in a flexible synthetic covering for ease of maintenance and cleaning as will be evident to those skilled within the art.

Figure 9:
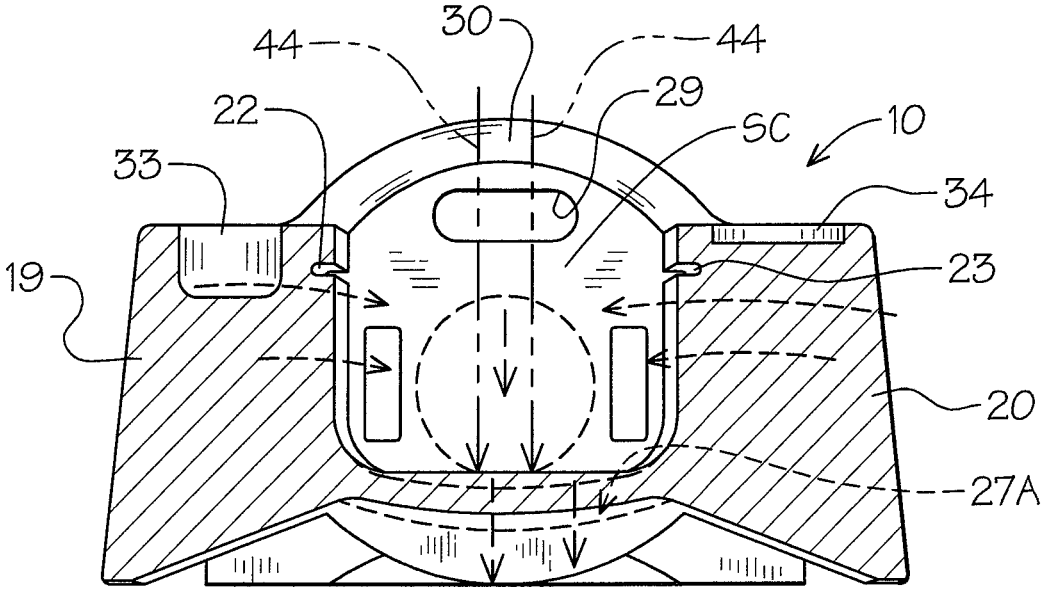
FIG. 9 is a sectional view on lines 9-9 of FIG. 7.
Figure 10:
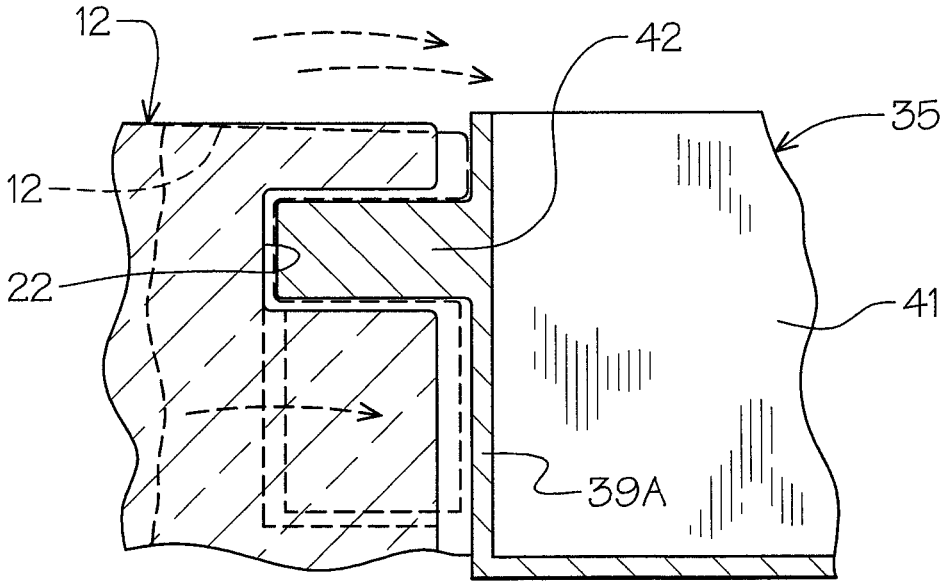
FIG. 10 is an enlarged partial sectional view illustrating tray retainment engagement in solid and broken lines by deformation of arm support receiving slots.

The cross-sectional dimensions of the contoured seat bottom 27 indicated at 27A in FIG. 9 of the drawings provide for the deflection force movement illustrated by broken lines indicating the force transfer through the respective arm portions 19 and 20, as noted, imparting a surface compression towards one another thereby engaging and retaining the tray portion 35, as noted, there between.

While the imparted gripping action to retain the tray is significant, it can be overcome by a caretaker, not shown, and removed while the infant I is still seated, if required.

It will be evident that the dimensions of the infant support cushion chair seat 10 are such as to provide adjustable engagement with the infant I within a certain early age group associated with primary motor skill development such as sitting. The cushion configuration of the invention will also serve as a comfortable confinement placement device assuring a safe and stable entertainment upright environment for the infant and affording a hands off orientation action for the parents or caregiver, not shown. The dimensional aspects of the infant cushion of the invention 10 is defined by the height of the main body member arm portions 20 and 21 being such that the infant's arms A will always be above the arm portion surfaces 12 and 13 allowing for easy access to the hereinbefore described item receiving recesses there within.

Figure 11:
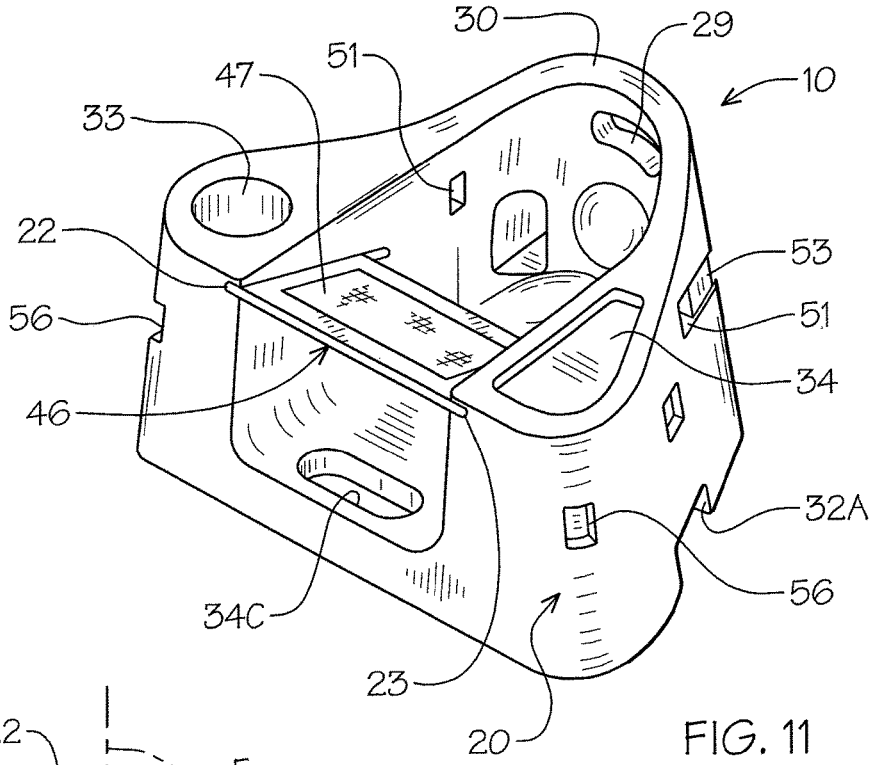
FIG. 11 is a perspective view of the infant support cushion chair with an alternate tablet insert.
Figure 12:
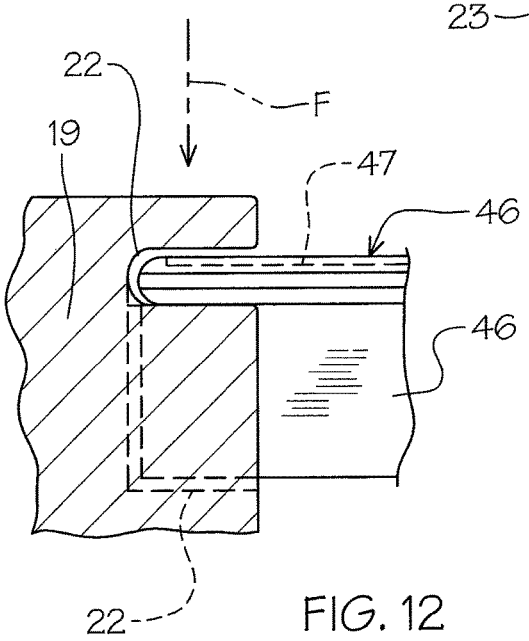
FIG. 12 is an enlarged partial cross-sectional view illustrating tablet insert engagement.
Figure 13:
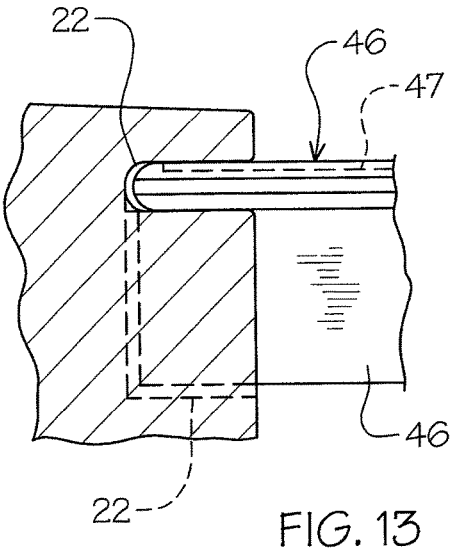
FIG. 13 is an enlarged partial cross-sectional view illustrating tablet retainment engagement by arm support deformation under load.

Referring now to FIGS. 11, 12 and 13 of the drawings, an alternate insert can be seen wherein a tablet shaped device can be selectively inserted and retained within the hereinbefore described arm slots 22 and 23. An electronic tablet 46, in this example, having a flat rectangular configuration with a viewing screen area 47 and spaced parallel edge engagement surfaces 48 which are thereby inserted and retained within the respective slots 22 and 23. Once positioned, deflection of the arm portions 19 and 20 by the imparted infant placement, as previously described, instituted the gripping action of the slots 22 and 23 retaining the tablet 46 there within as seen sequentially in FIGS. 12 and 13 of the drawings.

Should the infant strap retainment assembly 50 be required, strap elements indicated by broken lines would extend through the respective strap guide openings 51 and 52 around the back wall within a guide channel 53, therebetween a crotch engagement plate 54 having a pair of straps S extending from with a central seat opening 55 indicated in broken lines would be provided so as to loop out over the infant I and then across and through the hereinbefore described guide openings.

Referring to FIGS. 1, 2, 6 and 7 of the drawings, multiple toy retainment recesses 56 can be seen within the respositioned outer surfaces of sidewalls 15, 16 and front wall transitional surfaces there between. The recesses 56 provide for optimum removal attachment of toy elements, not shown.

It will be evident that such a strap configuration would have an appropriate retainment fastener so as to provide adjustable confinement of the infant dependent on infant size and placement there within.

It will thus be seen that a new and novel infant support seat cushion chair has been illustrated and described and it will be apparent to those skilled in the art that various changes and modifications may be made therein without departing from the spirit of the invention.

Therefore I claim:

1. A support device for an infant in a sitting position comprises, a triangular shaped cushion base configuration having a top surface with interconnected depending sides, front and rear back wall surfaces, a central infant receiving opening within said top surface, a pair of inclined arm rest portions in angular opposition formed within the cushion base configuration in spaced relation to one another, a containment and utility tray receiveably retained between said respective arm rest portions overlying and defining an infant leg opening, a tray retainment slot in each of said respective arm portions, said retainment slots are in angularly disposed spaced longitudinally to inclined arm rest top surface portions, said tray retainment slots in horizontal aligned effacing relation to one another, said inclined arm rest portions and said respective retainment slots there within are deformable from a first static open spaced tray receiving positions to a second translateral deformed tray engagement positions, said utility tray removable from a first horizontal deformed arm rest slot engagement retainment position to a second infant access position in spaced relation to said respective arm rest slots.

2. The support device for an infant set forth in claim 1 wherein said central infant receiving opening has an upstanding curved back rest portion with a contoured protrusion extending therefrom and an elongated hand engagement opening there within in spaced relation thereto.

3. The support device for an infant set forth in claim 1 wherein said containment and utility tray has a contoured curvilinear upstanding rear wall and upstanding spaced parallel sidewalls and interconnecting front wall extending therefrom and spaced parallel exterior guide rails on said respective sidewalls, said guide rails registerable within said respective tray retainment slots.

4. The support device for an infant set forth in claim 1 wherein said arm rest portions have infant containment strap harness guide openings extending there through interconnected by a recessed guide channel in the said cushion base configuration depending sides and back wall exterior surfaces, and strap harness openings ii through said rear back wall surface adjacent respective arm portion harness openings and a central seat opening through said infant receiving opening.

5. The support device for an infant set forth in claim 1 wherein said cushion base configuration comprises a resilient foam core with a yieldable encapsulating cover thereabout.

* * * * *